US012364322B2

(12) United States Patent
Keidel

(10) Patent No.: US 12,364,322 B2
(45) Date of Patent: Jul. 22, 2025

(54) ADJUSTABLE MOUNT FOR A BACKPACK OR SCHOOLBAG

(71) Applicant: Stephan Keidel, Iserlohn (DE)

(72) Inventor: Stephan Keidel, Iserlohn (DE)

(73) Assignee: SUDHAUS GMBH, Iserlohn (DE)

( * ) Notice: Subject to any disclaimer, the term of this patent is extended or adjusted under 35 U.S.C. 154(b) by 188 days.

(21) Appl. No.: 18/235,087

(22) Filed: Aug. 17, 2023

(65) Prior Publication Data

US 2024/0115032 A1 Apr. 11, 2024

(30) Foreign Application Priority Data

Oct. 5, 2022 (DE) ..... 102022125646.4

(51) Int. Cl.
*A45F 3/04* (2006.01)
*A45F 3/08* (2006.01)

(52) U.S. Cl.
CPC ..... *A45F 3/08* (2013.01); *A45F 3/047* (2013.01)

(58) Field of Classification Search
CPC .... A45F 3/047; A45F 3/04; A45F 3/08; A45F 3/042
USPC ..... 224/631, 632
See application file for complete search history.

(56) References Cited

U.S. PATENT DOCUMENTS 5,004,135 A * 4/1991 Dufournet ..... A45F 3/047 224/907
5,165,719 A * 11/1992 Yano ..... B60R 22/201 280/801.2
9,332,821 B2 * 5/2016 Janssen ..... A45F 3/04
9,591,910 B2 * 3/2017 Kemp ..... A45F 3/047
10,234,242 B2 * 3/2019 Castrati ..... A41D 1/04
D849,332 S * 5/2019 Ekberg et al. ..... D29/124
10,342,318 B2 * 7/2019 Winfield ..... A45F 3/047
10,813,437 B2 * 10/2020 Behringer ..... A45F 3/14
10,920,928 B2 * 2/2021 Lennings ..... A45F 3/14
10,932,547 B2 * 3/2021 Lennings ..... A45F 3/14
11,445,806 B2 * 9/2022 Chen ..... A45F 3/047
11,758,998 B2 * 9/2023 Keidel ..... A45F 3/047 224/201

(Continued)

FOREIGN PATENT DOCUMENTS

CN 104394733 B * 8/2016 ..... A45F 3/04
CN 213464144 U * 6/2021 ..... A45F 3/02
DE 3605532 A1 * 8/1987

(Continued)

*Primary Examiner* — Justin M Larson
(74) *Attorney, Agent, or Firm* — Andrew Wilford

(57) ABSTRACT

An adjustable mount for a backpack has a housing secured to the backpack rear wall. A slide movable vertically inside the housing is formed with at least one transversely open recess. A support plate secured to the backpack straps is axially fixed to the slide for joint axial movement therewith. A rack rod rotatable but axially fixed in the housing has a plurality of axially spaced and radially projecting teeth. The rack rod is rotatable between a locking position with at least one of the teeth engaged in the recess and thereby preventing movement of the slide in the housing and a freeing position with the teeth disengaged from the slide and the slide and support plate relatively movable. An actuating element projecting from and fixed to the rod outside the housing is actuatable by the wearer of the backpack to rotate the rod its positions.

8 Claims, 3 Drawing Sheets

(56) References Cited

U.S. PATENT DOCUMENTS

| | | | | | |
|---|---|---|---|---|---|
| 12,156,584 | B2 * | 12/2024 | Wilsey | ..... | A47L 5/36 |
| 2024/0115032 | A1 * | 4/2024 | Keidel | ..... | A45F 3/04 |

FOREIGN PATENT DOCUMENTS

| | | | | | |
|---|---|---|---|---|---|
| DE | 202013004306 | U1 * | 9/2014 | ..... | A45F 3/042 |
| DE | 102014006194 | A | 11/2014 | | |
| DE | 102020115587 | A1 * | 12/2021 | | |
| DE | 102022125646 | A1 * | 4/2024 | ..... | A45F 3/04 |
| EP | 4349212 | A1 * | 4/2024 | ..... | A45F 3/04 |
| FR | 2664139 | A * | 1/1992 | ..... | A45F 3/047 |
| IL | 226809 | A * | 11/2018 | | |
| JP | H0622817 | A * | 2/1994 | | |
| KR | 20240059280 | A * | 5/2024 | | |
| WO | WO-2018198133 | A1 * | 11/2018 | | |
| WO | WO-2016207896 | A1 * | 12/2018 | ..... | A45C 13/30 |

* cited by examiner

ADJUSTABLE MOUNT FOR A BACKPACK OR SCHOOLBAG

FIELD OF THE INVENTION

The present invention relates to an adjustable mount for a backpack or school bag.

BACKGROUND OF THE INVENTION

A backpack, which term here covers a school bag or the like, has shoulder straps is secured by an adjustable mount to the outside of a rear wall of the backpack by an adjustable mount comprising a housing of substantially rectangular basic shape with a base part and a housing cover. The base part has longitudinally extending guide rails that project into the interior of the housing and along which a slide that can move and be locked in position. This slide is indirectly connected by a support plate to the shoulder straps for displaceably adjusting the backpack in different positions together with the slide along the rail between two end positions and/or for securing them on parts of the housing. Such adjustment and/or locking is effected by a latch element that can be moved out of a locking position into a freeing position and that is displaceable from the locking position into the freeing position and vice versa. In the freeing position the slice displaceable within the housing and the support plate is displaceable outside the housing cover in a direction parallel to slots formed in the housing cover. The adjustable mount together with the slide, the support plate and the latch element are both on the outside of the rear wall of the backpack and are actuatable or operable from outside the backpack. Such a backpack is widely used in the state of the art and is very popular.

In order to make it possible for a wearer to carry the backpack or school bag ergonomically and comfortably, it generally has two shoulder straps for placing on and carrying on the wearer's back. These shoulder straps are close to each other in their upper end region and there directly or indirectly connected to each other. The adjustable mount is provided in this connecting region and enables the height of the shoulder straps to be adjusted relative to the backpack. Such a height adjustment serves in particular to adapt the backpack or the school bag to the body size of a wearer by setting the height relative to the shoulder straps that matches the body size.

Adjustable mounts of a similar type are known in the prior art in various designs. For example, a first adjustable mount of a similar type is known from DE 10 2014 006 194 in which height adjustment is effected by actuating an operating element that adjusts a deformable spring latch element from a blocking shape to a release shape and vice versa. In this solution, in the blocking shape the spring latch element fixes the slide to a detent rail and in the release shape the spring latch element releases the slide relative to the detent rail so that the slide can be displaced relative to the detent rail.

The operating element of this adjustable mount is on the outside of the rear wall of the backpack, facing the back of the wearer. It can be operated by a coin, for example, and can move the adjustable mount from a freeing position to a blocking position and back.

However, adjustment can only be carried out when the backpack is not on the back of a wearer, as access to the control element that is located on or on the adjustable mount is blocked by the wearer's back in this wearing position. In practice, this means that the backpack must be removed from the wearer's back in order to adjust the height, a height adjustment can then be carried out and, after being fixed in the now adjusted position, the backpack must be placed back on the wearer's back. If, for example, the desired position has not yet been reached after the adjustment has been made again, this procedure must be carried out again.

On the one hand, this is time-consuming and, on the other hand, it is often considered undesirable by the consumer.

OBJECTS OF THE INVENTION

It is therefore an object of the present invention to provide an improved adjustable mount for a backpack.

Another object is the provision of such an improved adjustable mount for a backpack that overcomes the above-given disadvantages, in particular in which height adjustment is possible by actuating the adjustable mount even when it is on the back of a wearer, that can be produced inexpensively and simply and that has a long service life and allows adjustment by the wearer without the aid of tools or other aids.

SUMMARY OF THE INVENTION

An adjustable mount for a backpack having a rear wall attached to shoulder straps has according to the invention a housing secured to the rear wall and of substantially rectangular basic shape and formed by a base part and a cover part. longitudinally extending guide rails on one of parts project into the housing. The other part is formed with longitudinally extending slots. A slide is movable along the rails inside the housing and formed with at least one transversely open recess. A support plate secured to the straps is axially fixed through the slots to the slide for joint axial movement therewith. A rack rod extending along a longitudinal axis between the rails is rotatable about the axis on the housing but axially fixed thereto and has a plurality of axially spaced and radially projecting teeth. The rack rod is rotatable between a locking position with at least one of the teeth engaged in the recess and thereby preventing movement of the slide and support plate relative to the housing and a freeing position with the teeth disengaged from the slide and the slide and support plate movable relative to the housing so that the backpack can be vertically adjusted on a wearer of the backpack in the freeing position. An actuating element projecting radially from and fixed to an end of the rod outside the housing is actuatable by the wearer of the backpack to rotate the rod between the locking position and the freeing position.

The vertical position of a backpack with such an adjustable mount according to the invention can thus be adjusted quickly and easily when being worn, i.e. while the backpack is on the back of a wearer. To do this, the wearer merely reaches around his or her own body in the direction of the backpack to feel and grasp the actuating element located above or below the support plate connected to the shoulder straps. As soon as the wearer has felt the actuating element with his fingers, he can easily pivot it manually from the latched position to the released position. The slide can now be moved together with the support plate on the shoulder straps up or down in order to adjust the position of the backpack on the wearer's back to a desired height. Once the desired height has been reached, the wearer manually pivots the actuating element back into its latched position so that this position is set until next time the actuator is manipulated to reset the backpack.

To enable adjustment as desired, actuation of the operating element releases the rack-rod teeth engaged in the locking position in recesses formed on the slide, so that the slide together with the support plate that is on the shoulder straps can be moved as desired inside the housing and the support plate with the shoulder straps attached to it can be moved outside along the housing cover up or down as desired.

After the desired position has been reached, actuation of the actuating element causes the rack rod together with the teeth to be rotated back into the locking position in which the teeth of the rack rod fit into the recesses formed on the slide, i.e. engage in them, and lock the slide and the support plate with the shoulder belts attached to it in this position.

The adjustable mount according to the invention thus makes it possible to adjust the height at any time in a particularly simple and convenient manner even when the backpack is worn, i.e. when it is on the wearer's back, without having to remove the backpack from the shoulders.

In addition, such a solution, formed by a rack rod with teeth that engage in the slide, represents a particularly cost-effective and easy-to-manufacture solution that is also particularly robust and durable.

In particular, it may be particularly preferred that the rack rod is cylindrical and its teeth project approximately radially from the normally vertical axis of the rack rod, In addition, spacings between two adjacent teeth and the recesses formed on the slide are equal.

The cylindrical design of the toothed rack rod makes it particularly easy to rotate the rack rod in the housing and allows a large number of adjustment operations without wear.

In addition, the spacing of the teeth and corresponding recesses on the slide, especially when adjacent teeth and corresponding recesses are closely spaced, allows for virtually infinite height adjustment.

Further, it may be particularly preferred that the actuating element be on the upper end and/or at the lower end of the rack rod.

This allows the wearer or user to provide an actuating element either above the housing of the adjustable mount or below this housing in order to be accessible there. In a solution that is particularly convenient for the wearer, an actuating element can also be arranged at both ends of the rack rod.

In addition, it may be particularly preferred that the rack rod or the actuating element is biased into the locking position by a spring. This ensures that, at all times when the operating element is not actuated, the rack rod together with its teeth remain in the latched position and prevents any undesired height adjustment. Only when the operator wishes to actuate the adjustable mount is the rack rod pivoted against the force of the spring by actuating the operating element into the freeing position in which its teeth are no longer in engagement with the recesses of the slide in order to adjust the height of the slide together with the support plate. As soon as the operator no longer operates the actuating element with his hands or fingers, it is automatically pivoted back into the latched position by the spring.

It is also particularly preferred that the actuating element extends orthogonally to the direction of adjustment of the slide, the support plate and the rack rod.

Due to the orthogonal orientation of the actuating element, it can be easily recognized and grasped by the wearer even when the backpack is on his back.

In addition, it may preferably be provided that the housing cover is detachably connectable or connected, for example by clipping or hooking, to a latch plate arranged on or in the rear wall of the school bag or backpack or to the lower housing part or to the latch plate and the lower housing part.

This also enables the individual parts of the adjustable mount to be assembled without tools in a particularly quick and simple and intuitive manner. Only the latch plate on or in the back panel of the school bag or backpack and fastened there may still have to be sewn to the back panel and thus fastened.

In this context, it may be particularly preferred to provide that the latch plate is fixed to the rear wall of the school bag or backpack.

Depending on the wishes of the manufacturer of such backpacks, the latch plate can be detachable or fixed to the rear wall.

In addition, it may preferably be provided that each support plate is fixed to the shoulder straps, in particular sewn, screwed, riveted or glued thereto.

The support plate can also be fixed to the shoulder straps where the shoulder straps meet, depending on the manufacturer of the backpack. In solutions known in the prior art, this fixation is usually made by sewing. Alternatively, a screw connection, riveting or bonding can also be considered.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 3:
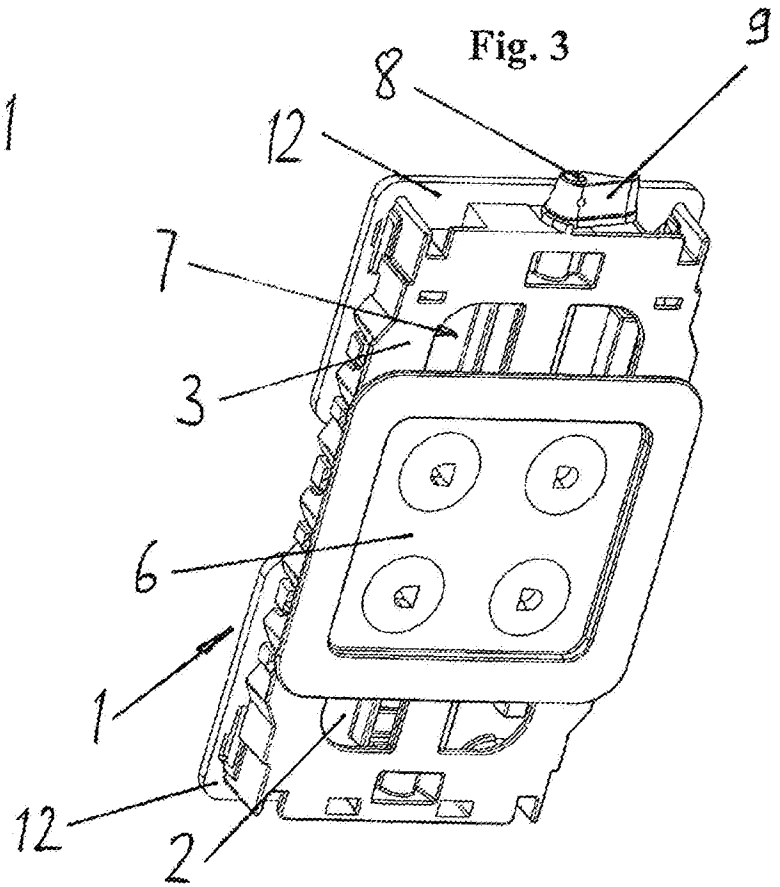
FIG. 3 is a view like FIG. 2 in the latched position.
Figure 4:
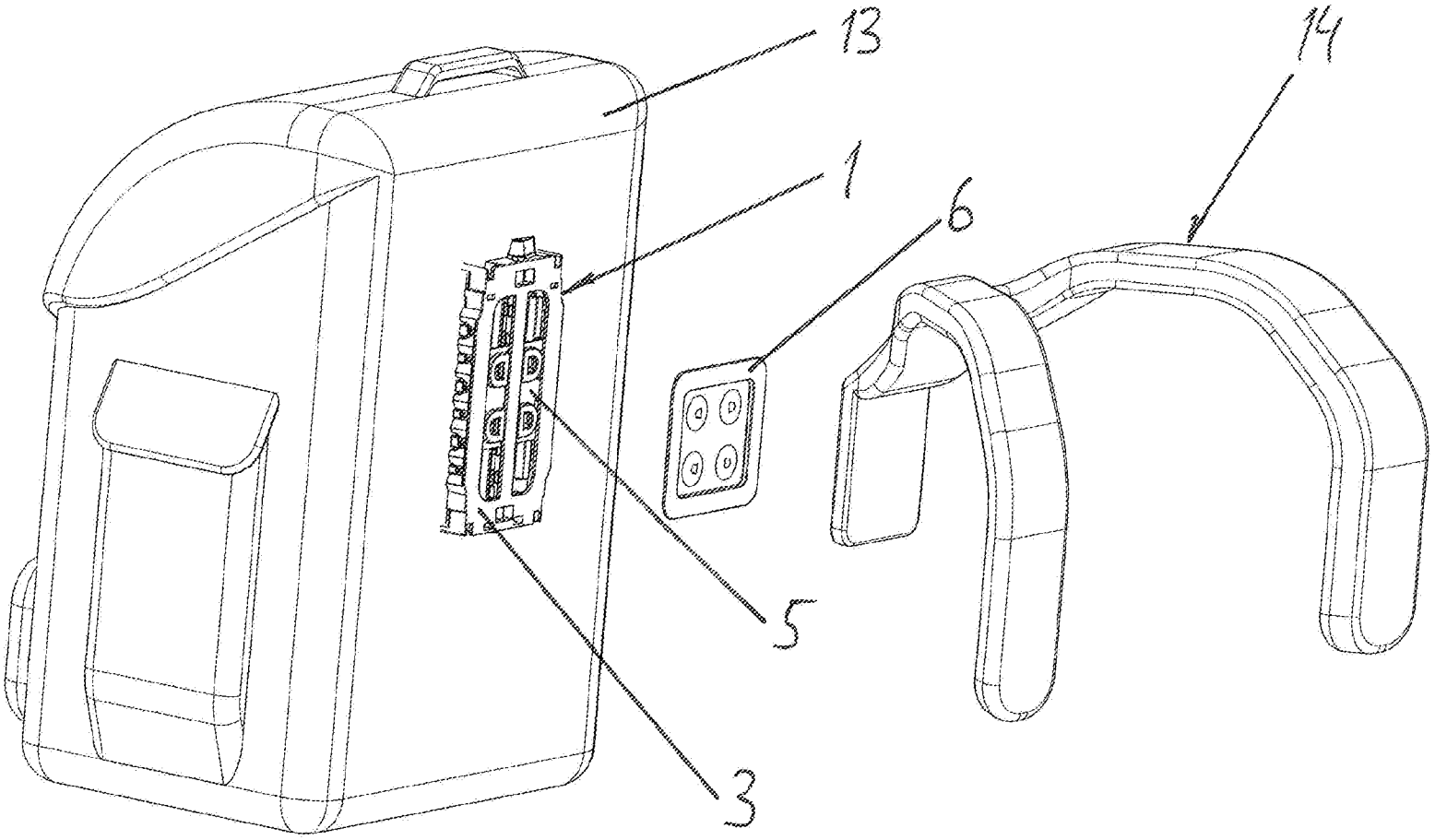
FIG. 4 is a view obliquely from the rear of the school bag according to the invention with an adjustable mount.

The drawing shows an adjustable mount 1 that can be attached (FIGS. 1 to 3) or is attached (FIG. 4) to the outside of the rear wall of a school bag 13 with shoulder straps 14 or unillustrated backpack. As mentioned above, the term "backpack" is intended to include a school bag or the like.

The adjustable mount 1 has a housing with a substantially rectangular basic shape. The housing is formed by a base part 2 and a housing cover 3. The base part 2 has longitudinally extending guide rails 4 projecting into the interior of the housing. A slide 5 can move along these guide rails 4 and be locked thereto in desired set positions. The slide 5 is or can s shown in FIG. 4 be connected to the shoulder straps 14 by a support plate 6.

Movement of the slide 5 together with the support plate 6 and the shoulder straps 14 of the school bag 13 attached thereto thus adjusts the height of the shoulder straps 14 relative to the school bag 13 or, in particular, relative to its rear wall. This serves to adjust the height of the school bag 13 according to the size of the wearer, so that a comfortable and ergonomic height is possible even when such a school bag 13 is worn for long period of time.

The school bag is secured in place by a latch element that can be moved from a latched position to a released position and vice versa. This makes it possible to lock the height-adjusted school bag 13 or the shoulder straps 14 in the set position in order to prevent unwanted further adjustment.

During adjustment, the slide 5 is basically moved with the support plate 6, whereby the support plate 6 is outside the housing of the adjustable mount 1 and the slide 5 is inside the housing of the adjustable mount 1.

As can be seen from the drawing, the adjustment takes place along slots 7 formed in the housing cover 3.

According to the invention, the latch element is formed by a toothed rack rod 8 set approximately centrally in the housing between the two longitudinally extending guide rails 4. The rack rod 8 can be adjusted by an actuating element 9 outside the housing and accessible there. The adjustment takes place between a first locking position in which teeth 10 formed on the toothed rack rod 8 engage in recesses 11 formed on the slide 5 and lock the slide 5 in this position and a second freeing position in which the teeth 10 of the toothed rack rod 8 do not engage in the recesses 11.

The opposite adjustment analogously is likewise made possible in a simple manner. For this the wearer of the school bag 13 or the backpack only has to grip the actuating element 9 by hand and turn it slightly in order to pivot the toothed rack rod 8 between the locking position and the freeing position.

In the manually set freeing position, adjustment of the slide 5 together with the support plate 6 and, if applicable, the shoulder straps 14 attached to the support plate 6 is made possible in a simple manner. To lock it in the position once set, the wearer only has to manually move the toothed rack rod 8 back into the latched position by turning the actuating element 9, so that in this position the height position is set and undesired height adjustment is effectively prevented.

The height adjustment of the shoulder straps 14 with respect to the adjustable mount 1 on the back of the school bag 13 is made possible by the actuating element 9 according to the invention that adjusts the rack rod 8 according to the invention, even when the school bag 13 or the backpack is on the back of the wearer. It is therefore not necessary to remove the school bag 13 or the backpack from the back in order to adjust it with regard to the height of the shoulder straps 14.

Figure 1:
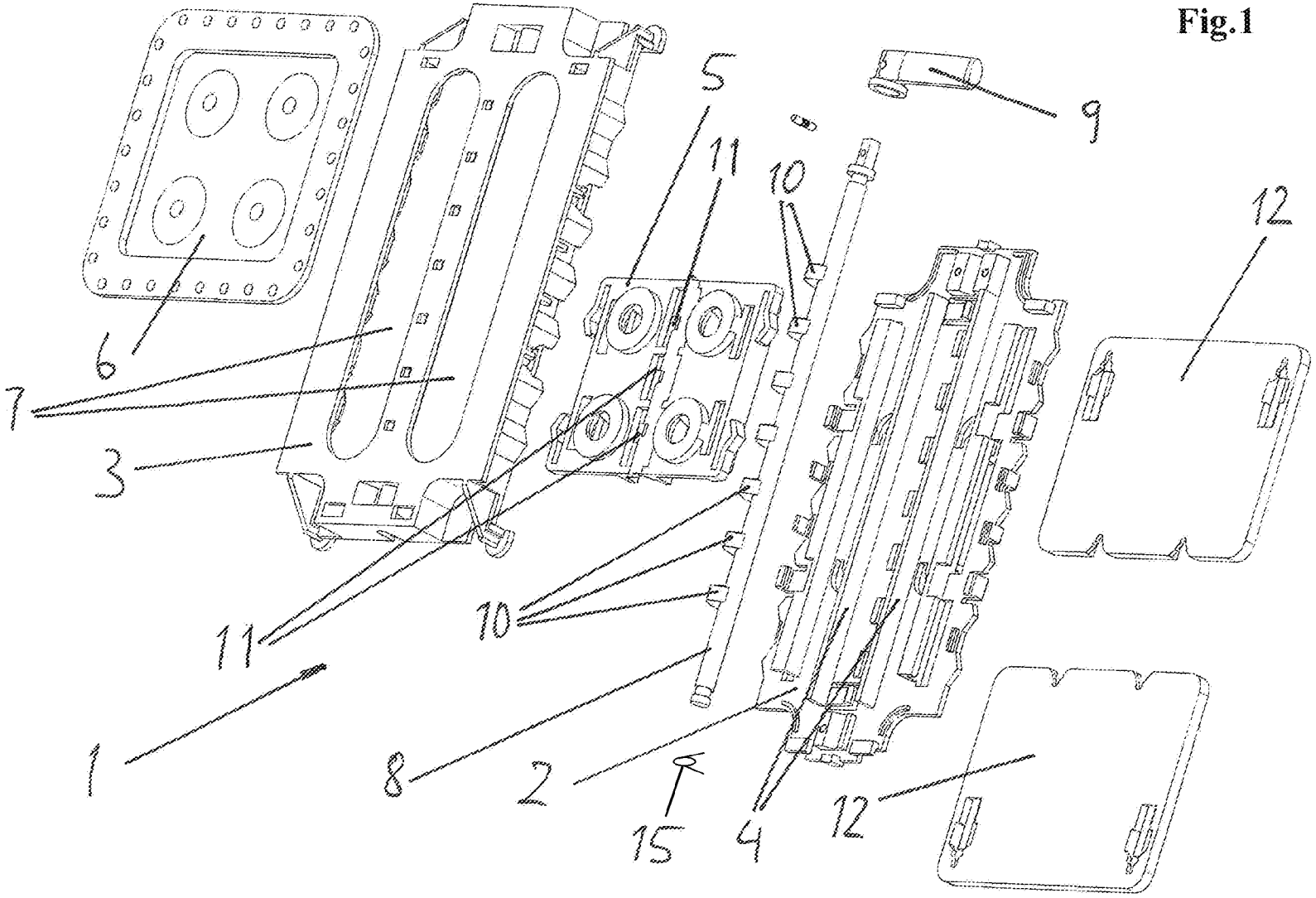
FIG. 1 is an exploded view of an adjustable mount according to the invention.
Figure 2:
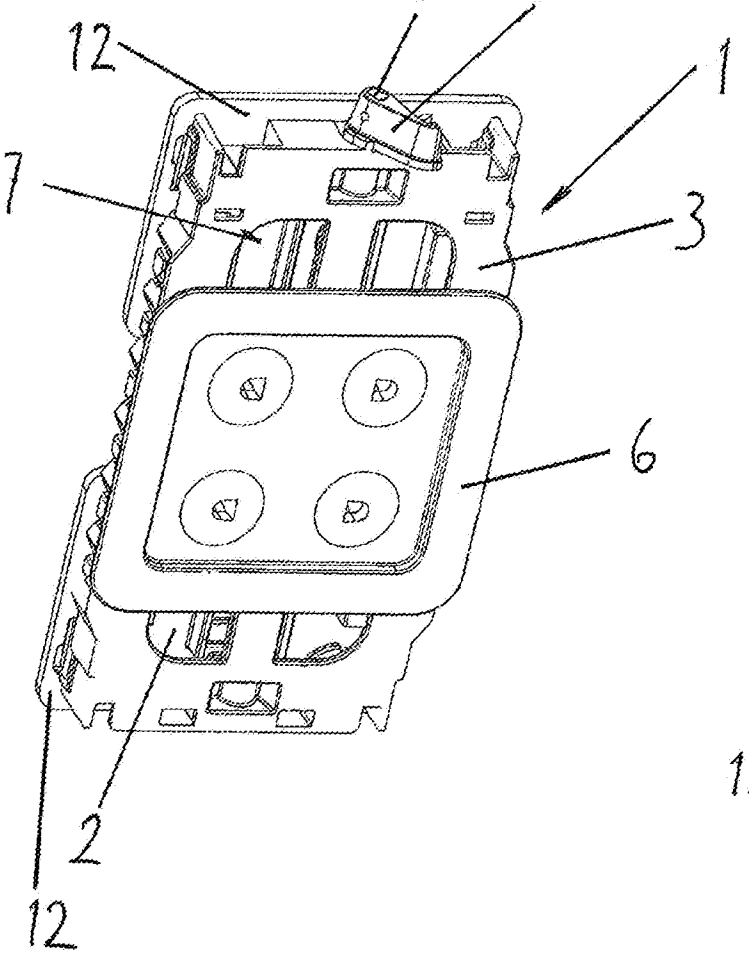
FIG. 2 shows another adjustable mount according to the invention in a rear view in the freeing position.

As can be seen in particular from FIG. 1, the rack rod 8 is cylindrical with its teeth 10 projecting approximately radially from the rack rod 8. The spacing between two adjacent, i.e. consecutive, teeth 10 and between the recesses 11 formed on the slide 5 is the same. The size of the teeth 10 corresponds to the size of the recesses 11, so that the teeth 10 are suitable for engaging in the recesses 11 and fitting snugly there.

In the embodiment shown in the drawing, the actuating element 9 is at the backpack of the rack rod 8. Alternatively, and not shown in the figures, the actuating element 9 can also be at the lower end of the toothed rack rod 8, i.e. opposite the upper end, or at both ends of the toothed rack rod 8. This ensures that the actuating element 9 is accessible at all times, depending on the height of the wearer.

Here, the rack rod 8 and thus the actuating element 9 attached to the rack rod 8 are held in the locking position against the force of a spring 15. This ensures that after adjustment the rack rod 8 and in particular its teeth 10 are pivoted back into the latched position and hold there. This effectively prevents accidental or unintentional adjustment of the position once it has been set.

The actuating element 9 projects orthogonally from the rack rod 8.

In the illustrated embodiment, the housing cover 3 is detachably connected or can be clipped to two latch plates 12 on the rear wall of the school bag 13 and fastened there. In this case, the latch plate or plates 12 are nondetachably fastened to the rear wall of the school bag 13 and, if necessary, covered there with cover fabric.

In a manner known per se, each support plate 6 is fixed to the shoulder straps 14; this connection is usually made by sewing, screwing or riveting. Bonding is also possible here.

The invention is not limited to the illustrated embodiment but is variable in many ways within the scope of the disclosure.

All new individual and combination features disclosed in the description and/or drawing are considered essential to the invention.

I claim:

1. An adjustable mount for a backpack having a rear wall attached to shoulder straps, the mount comprising:

a housing secured to the rear wall and of substantially rectangular basic shape and formed by a first part and a second part;

longitudinally extending guide rails on the first part and projecting into the housing, the second part being formed with longitudinally extending slots;

a slide movable along the rails inside the housing and formed with at least one transversely open recess;

a support plate secured to the straps and axially fixed through the slots to the slide for joint axial movement therewith;

a rack rod extending along a longitudinal axis between the rails, rotatable about the axis on the housing but axially fixed thereto, and having a plurality of axially spaced and radially projecting teeth, the rack rod being rotatable between a locking position with at least one of the teeth engaged in the recess and thereby preventing movement of the slide and support plate relative to the housing and a freeing position with the teeth disengaged from the slide and the slide and support plate movable relative to the housing, whereby the backpack can be vertically adjusted on a wearer of the backpack in the freeing position; and an actuating element projecting radially from and fixed to an end of the rod outside the housing and actuatable by the wearer of the backpack to rotate the rod between the locking position and the freeing position.

2. The adjustable mount according to claim 1, wherein the rack rod is cylindrical shape and the teeth project approximately radially from the rack rod, spacings between two adjacent teeth and the recesses formed on the slide being equal.

3. The adjustable mount according to claim 1, wherein there is one such actuating element on one end of the rod and on an opposite end of the rod.

4. The adjustable mount according to claim 1, further comprising:

a spring urging the rod into the locking position.

5. The adjustable mount according to claim 1, wherein the axis extends parallel to and between the rails and the actuating element extends radially of the axis.

6. The adjustable mount according to claim 1, further comprising:

a latch plate fixed on the rear wall and to the first part and the second part is releasably connected to the first part or the latch plate.

7. The adjustable mount according to claim 6, wherein the latch plate is fixed to the rear wall.

8. The adjustable mount according to claim 1, wherein the support plate is fixed to the shoulder straps by stitches, screws, rivets, or glue.

* * * * *